United States Patent [19]

Whitney et al.

[11] 4,316,295

[45] Feb. 23, 1982

[54] BATHING ENCLOSURE

[75] Inventors: Thomas M. Whitney; Gerald Gower, both of Lapeer, Mich.

[73] Assignee: Trayco, Inc., Lapeer, Mich.

[21] Appl. No.: 136,145

[22] Filed: Mar. 31, 1980

[51] Int. Cl.[3] ..... A47K 3/23; E04B 1/343; A47B 47/04

[52] U.S. Cl. ..... 4/612; 4/600; 4/614; 52/34; 52/264; 312/257 SK; 403/329

[58] Field of Search ..... 4/552, 596, 599, 612–614, 4/538, 555, 584, 600; 52/34, 35, 264, 596–599; 160/368 R; 312/257 SK, 140; 403/329, 330

[56] References Cited

U.S. PATENT DOCUMENTS

| | | | |
|---|---|---|---|
| 1,112,200 | 9/1914 | Dupont | 4/612 |
| 2,014,554 | 9/1935 | Bulthois | 4/614 X |
| 2,526,883 | 10/1950 | LaBarre | 52/35 |
| 2,879,561 | 3/1959 | Rieder | 403/329 |
| 3,149,347 | 9/1964 | Embroden | 4/614 X |
| 3,688,459 | 9/1972 | Mattix | 52/34 X |

FOREIGN PATENT DOCUMENTS

| | | | |
|---|---|---|---|
| 228429 | 12/1962 | Austria | 4/614 |
| 359264 | 2/1962 | Switzerland | 4/612 |
| 649695 | 1/1951 | United Kingdom | 4/612 |

*Primary Examiner*—Stuart S. Levy

*Attorney, Agent, or Firm*—Cullen, Sloman, Cantor, Grauer, Scott & Rutherford

[57] ABSTRACT

A knocked-down kit for assembling a shower stall or bath tub enclosure comprises a base panel, dome panel and three side panels, the side panels being interlocked by a split clamping tube which resiliently clamps together outwardly extending flanges along the abutting vertical edges of the side panels, and the side panels being interlocked with the base panel by a resilient flange which snaps over an outwardly extending flange along the upper periphery of the base panel as the side panels are lowered onto the base panel. The interlock between the dome and side panels is symmetrically opposite to the base-side panel interlock.

1 Claim, 5 Drawing Figures

BATHING ENCLOSURE

BACKGROUND AND SUMMARY OF INVENTION

There is a substantial market for light-weight, inexpensive yet attractively styled enclosures for bath tubs or showers which can be shipped in a compact knocked-down condition. One applicaton for such products is as original equipment installations for manufactured housing. Another application is for the individual homeowner who wishes to himself add such a bathing enclosure to his own home. For the latter application, the unit must lend itself to assembly with minimal skills and tools, and the unassembled purchased parts must be able to fit through the often narrow doorways of bathrooms.

The kits presently on the market have not been entirely satisfactory. They are often large and bulky, and often require screws or nuts and bolts to assembly the various panels. Such methods of fastening often produce problems, including leakage through the fastener-receiving holes, corrosion of the fasteners, and difficulty in properly cleaning the enclosure because of the dirt-catching crevices at the joints or around the fasteners. Furthermore, the fasteners are often objectionable and unsightly in such an enclosure.

Accordingly, it is the principal object of this invention to provide an improved knocked-down kit for a shower or bath tub enclosure wherein no fasteners are visible on the interior of the enclosure, no tools are required for assembly, and assembly can be quickly completed by an inexperienced and unskilled person.

DETAILED DESCRIPTION OF THE DISCLOSURE

Figure 1:
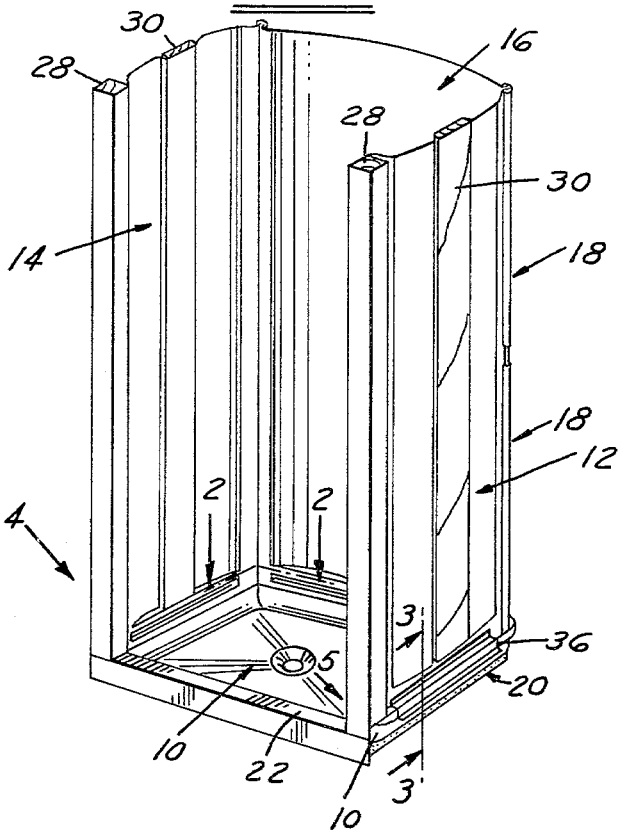
FIG. 1 is a simplified perspective view showing the base panel and three side panels of a shower enclosure constructed in accordance with the present invention.

Referring to FIG. 1, there is illustrated a portion of a shower enclosure constructed in accordance with the present invention, and generally comprising bottom panel 10, side panels 12, 14 and 16. For ease of explanation, the center side panel 16 will be hereafter referred to as the rear panel. Each of the panels may be vacuum formed rigid polyvinyl chloride having a thickness of 0.090 inches on the side and rear panels and 0.150 inches on the base panel.

For ease of illustration, no shower door or dome is shown. Such components can be assembled to the enclosure as will be discussed hereinafter.

The side and rear panels 12, 14 and 16 may be provided with formations for increasing their rigidity, as is well known to those skilled in the art, or additional formations adapted to receive plumbing fixtures, soap dishes or safety handles. However, none of such features form a part of the present invention, and have therefore been generally omitted from the illustration.

Figure 2:
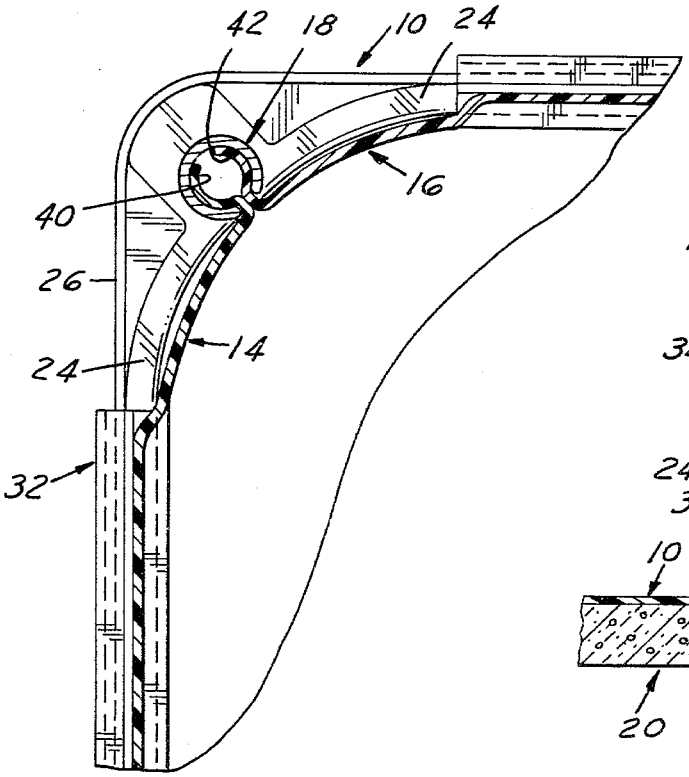
FIG. 2 is a fragmentary plan view cross-section viewed in the direction of arrows 2—2 of FIG. 1.

As best shown in FIGS. 1 and 2, the vertical joints between each of side panels 12, 14 and rear panels 16 are clamped together by means of an elongated split clamping tube 18, in a manner to be further described below.

Base panel 10 is reinforced and supported by a contoured polystyrene foam base block 20 (shown in FIGS. 3–5), which may have a density of approximately one and three-quarter pounds per cubic foot.

Figure 5:
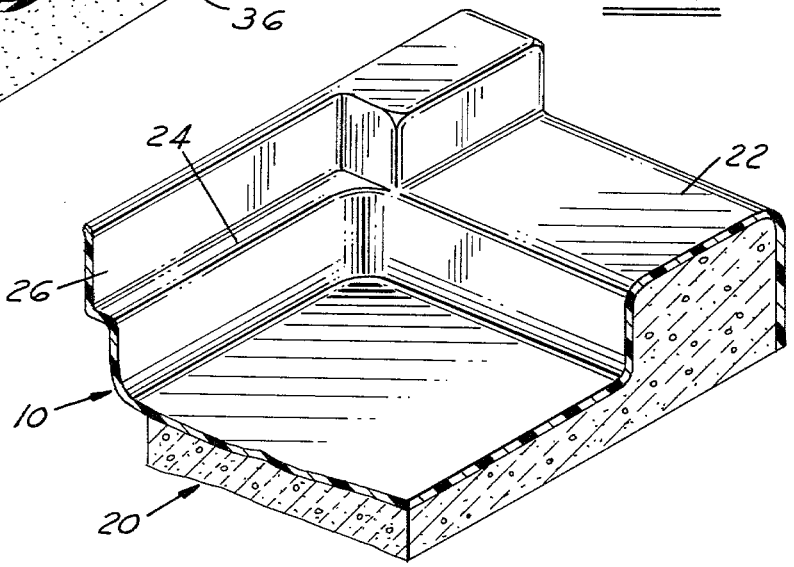
FIG. 5 is a fragmentary perspective view in the direction of arrow 5 of FIG. 1.

As best shown in FIGS. 1 and 5, bottom panel 10 is provided with a front sill 22 at the front opening of the enclosure, as is conventional. Furthermore, a horizontal ledge 24 extends around the other three sides of bottom panel 10, such ledge being formed by an outwardly extending flange which terminates in an upwardly extending vertical flange 26.

Figure 4:
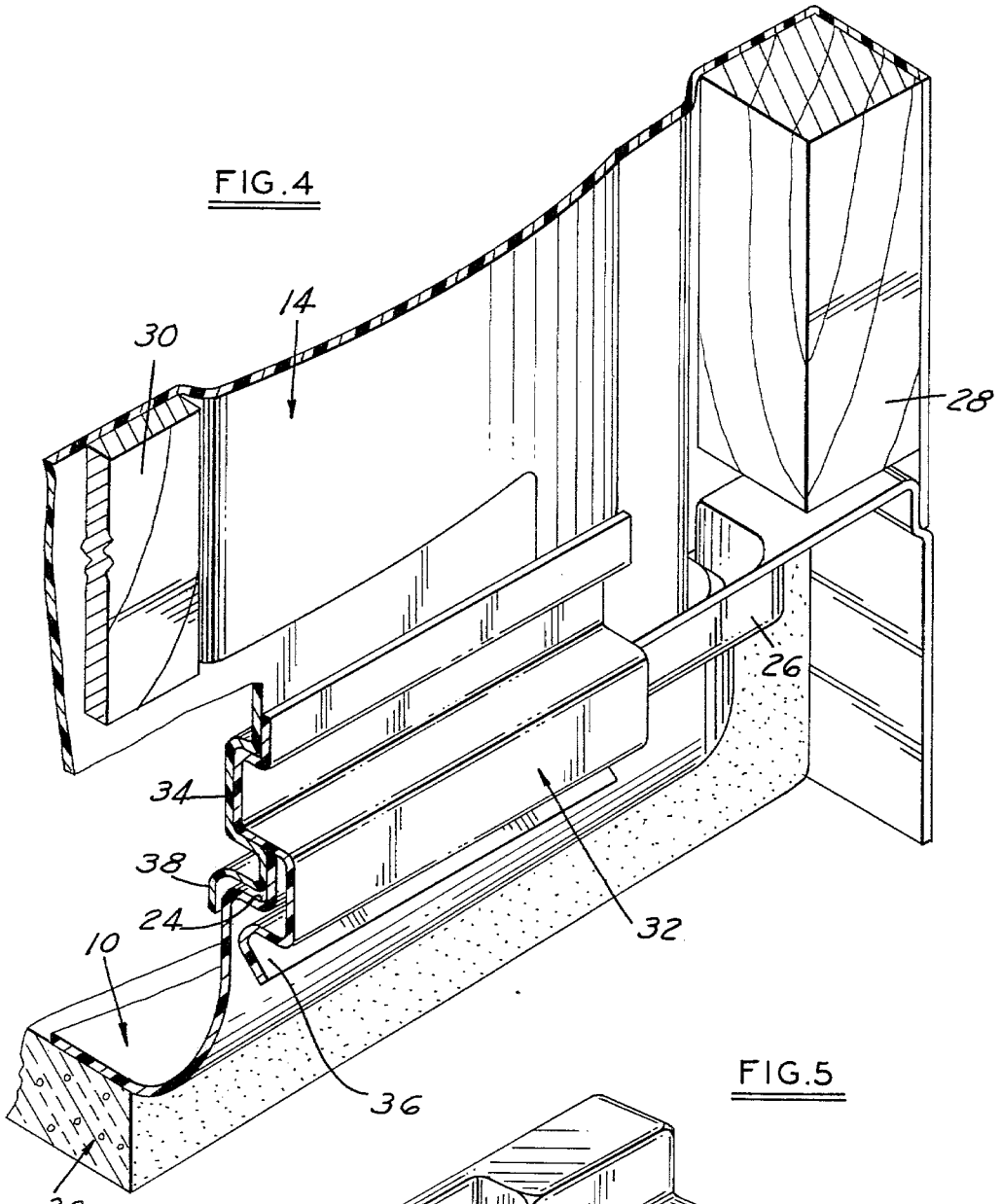
FIG. 4 is a fragmentary perspective view in the direction of arrow 4 of FIG. 1.

Each of the front ends of side panels 12, 14 is contoured to partially enclose a wooden reinforcing post 28, shown in FIGS. 1 and 4, which functions not only to aid in reinforcing the side panels and maintaining their desired verticality, but serves as an anchor for receiving the hinge and latch hardware for a shower door. Additionally, as shown in FIG. 4, other wood reinforcing members can be glued to the outer surfaces of the side and/or rear panels, such as shown at 30. These reinforcements may, in addition to providing additional rigidity to the structure, serve as anchors for securing such components as faucets or safety bars.

The lower edge of side and rear panels 12, 14 and 16 have secured thereto a snap lock member 32 secured by means such as solvent welding along area 34. Snap lock members 32 are provided with a locking flange 36 which, as a result of the contours of member 32, is capable of resiliently yielding outwardly during assembly, as will be described below. Side and rear panels 12, 14 and 16 terminate in a bottom flange 38 which fits inside of upper flange 26 of base panel 10. The vertical edges of side and rear panels 12, 14 and 16 terminate in corner flanges 40, 42, respectively, as shown in FIG. 2, these flanges cooperating with clamping tubes 18 as will be described below.

Figure 3:
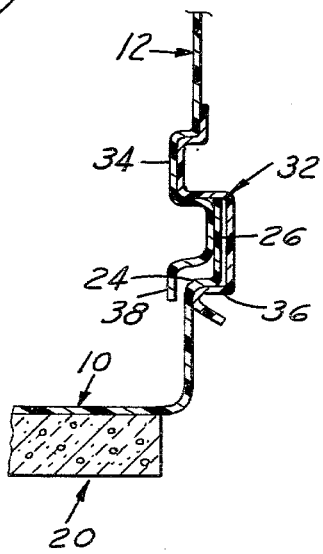
FIG. 3 is a fragmentary elevational cross-section viewed in the direction of arrows 3—3 of FIG. 1.

The enclosure described herein is designed to be installed within a conventional dry wall or paneled pocket reinforced by vertical studs. To assemble the enclosure, bottom panel should be placed on the floor near an object which will support a side panel in an upright position during the assembly procedure. Next, one of the side or rear panels is assembled to the base panel by positioning its lower edge in such a way that upper flange 26 of the base panel fits between flanges 36 and 38 at the bottom of the vertical side or rear panel, as shown in FIGS. 3 and 4. Downward pressure, possibly aided by an outward deflection of flange 36, will cause locking flange 36 to pass outside of and below upper flange 26 of base panel 10, and ultimately snap inwardly to interlock with the underside of ledge 24. The same process is then repeated with the remaining side and rear panels.

The vertical joints between adjacent panels are clamped together by clamping tubes 18. Preferably, corner flanges 40, 42 are interrupted by a gap at approximately the mid-point of the height of the panels, which permits a clamping tube half as long as the height of the enclosure to be inserted downwardly over such corner flanges, starting at such gap. After the first of such clamping tubes is slid downwardly all the way to the bottom of the enclosure, a second half-length clamping tube is inserted at the gap and slid upwardly therefrom, it being slid upward just far enough to pass the upper edge of the bottom clamping tube. Once assembled, the two tubes at each joint should be abutted together at the center.

The necessity for two tubes at each joint arises because of the unavailability of sufficient vertical clearance when the enclosure is upright to permit a single full-length clamping tube to be slid downwardly from above the enclosure.

As will be appreciated from FIG. 2, the resilience of clamping tube 18 functions to resiliently press together the abutting adjacent edges of rear panels 16 and either side panel 12 or 14. The contour of corner flanges 40, 42 prevents split clamping tube 18 from being removed in any direction but vertical, thus assuring retention in ordinary use. The configuration of the corner joint also assures that any water which may pass outwardly between abutting corner flanges 40, 42 will be trapped within clamping tube 18 and will run down the inside walls thereof, ending up within bottom panel 10 because of the location of clamping tube 18 inside of the upper flange 26 of bottom panel 10. Leakage is thereby provided without the need to apply any sealant.

As best shown in FIG. 3, bottom flange 38 of the side and rear panels extends inwardly and below upper flange 26 and ledge 24 of the bottom panel, thus assuring that water will not splash or leak out of the enclosure over the top of the bottom panel. Again, no sealant is required to prevent leakage.

While not illustrated herein, the enclosure would preferably be provided with a top panel or dome which, along with the upper edges of the side and rear panels, would be contoured to interlock in the same fashion as the baseside panel interlock. That is, the flanges would be a mirror image of those at the lower end and would function and be assembled in the same manner. Furthermore, such an arrangement makes the two side panels reversible so that either can be a "right" or a "left".

When these steps have been completed, the shower enclosure will be completely self-supporting, and can be drilled for plumbing.

Preferably, portions of the outer surfaces of the side and rear panels may be coated with a panel adhesive which, when the enclosure is installed and its receiving pocket, can be cammed outwardly by throw-away corrugated cardboard templates included in the kit to force the walls outwardly against the pocket until the adhesive sets.

It will be appreciated by those skilled in the art that the interlock between the illustrated shower base and side panels, as well as the clamping means used at the vertical joints, can also be applied to a bath tub enclosure, with appropriate changes in the base so that it forms a tub of suitable length, width and height.

This invention may be further developed within the scope of the following claims. Accordingly, the above specification is to be interpreted as illustrative of only a single operative embodiment of the present invention, rather than in a strictly limited sense.

I now claim:

1. In a bathing enclosure kit adapted to be packaged and sold in a knocked-down condition as a series of generally flat panels for on-site assembly into a multiple-sided stall shower or bath tub enclosure comprising a base panel and a plurality of side panels, each formed of a semi-rigid plastic sheet, the improved joint construction for assembling such panels wherein:

the base panel is a single unitary generally pan-shaped sheet with a generally horizontal planar bottom portion and upwardly turned side walls at all of its lateral edges, the upper portions of said sidewalls having a narrow horizontally and outwardly extending ledge and a generally vertical flange extending upwardly therefrom, said ledge and said flange extending around the periphery of said base panel at least in the areas that are adapted to interlock with the lower portions of the side panels;

the lower portions of each of the side panels having a locking strip bonded to the outer surface thereof at an elevation spaced above the lower ends of each of said side panels and said locking strips, the lower end of said side panel adapted to extend inside of said base panel side wall ledge and to an elevation below that of said ledge so as to conceal it from normal view and aid in preventing water from splashing over the base panel side wall flange, said locking strip having a ledge extending generally horizontally and outwardly from an elevation below that of said bonding area and adapted to normally engage and seat upon the upper edge of said vertical flange of the base panel side wall, and said locking strip further having a locking flange extending downwardly and inwardly from said locking strip ledge on the outer and under side of the vertical flange and ledge, respectively, of the base panel side wall, said locking flange being capable of resiliently yielding outwardly to permit said locking flange to clear said base panel side wall during downward assembly of the side panel onto the base panel, and said locking flange snapping back into its normal position at the completion of assembly to interlock with the underside of said ledge of the base panel side wall;

whereby the side panels are assembled to the base panel without the need for any supplementary fasteners.

* * * * *